United States Patent [19]

Born et al.

[11] 4,216,699

45] Aug. 12, 1980

[54] ELECTROHYDRAULIC CONTROL FOR AN AXIAL PISTON PUMP

[75] Inventors: Ellis H. Born, Columbus; Paul B. Wolfe, Dublin; Leo H. Dillon, Columbus, all of Ohio

[73] Assignee: Abex Corporation, New York, N.Y.

[21] Appl. No.: 939,311

[22] Filed: Sep. 5, 1978

[51] Int. Cl.[2] ..... F15B 13/16; F15B 13/044; F01L 21/02

[52] U.S. Cl. ..... 91/3; 91/189 A; 91/387; 91/459; 91/506; 92/138

[58] Field of Search ..... 91/189 A, 189 R, 387, 91/506, 3

[56] References Cited

U.S. PATENT DOCUMENTS

| | | | |
|---|---|---|---|
| Re. 14,230 | 12/1916 | Earl et al. | 91/189 A |
| 3,394,721 | 7/1968 | Ifield | 91/189 R |
| 3,429,225 | 2/1969 | Keyworth | 91/506 |
| 3,750,532 | 8/1973 | Kubilos | 91/387 |
| 3,982,470 | 9/1976 | Adams | 91/506 |

*Primary Examiner*—Paul E. Maslousky
*Attorney, Agent, or Firm*—Thomas S. Baker, Jr.; David A. Greenlee

[57] ABSTRACT

The instant invention relates to an electrically operated control which operates the displacement setting mechanism of a variable displacement pump and allows the displacement mechanism to be manually operated when the electrically operated control is disabled.

10 Claims, 12 Drawing Figures

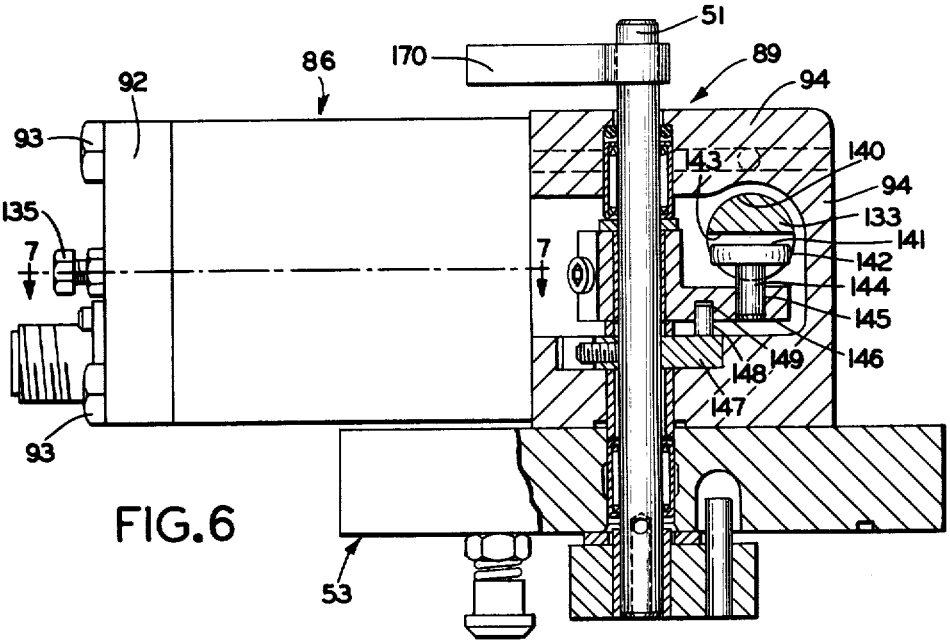
FIG.6
FIG.5
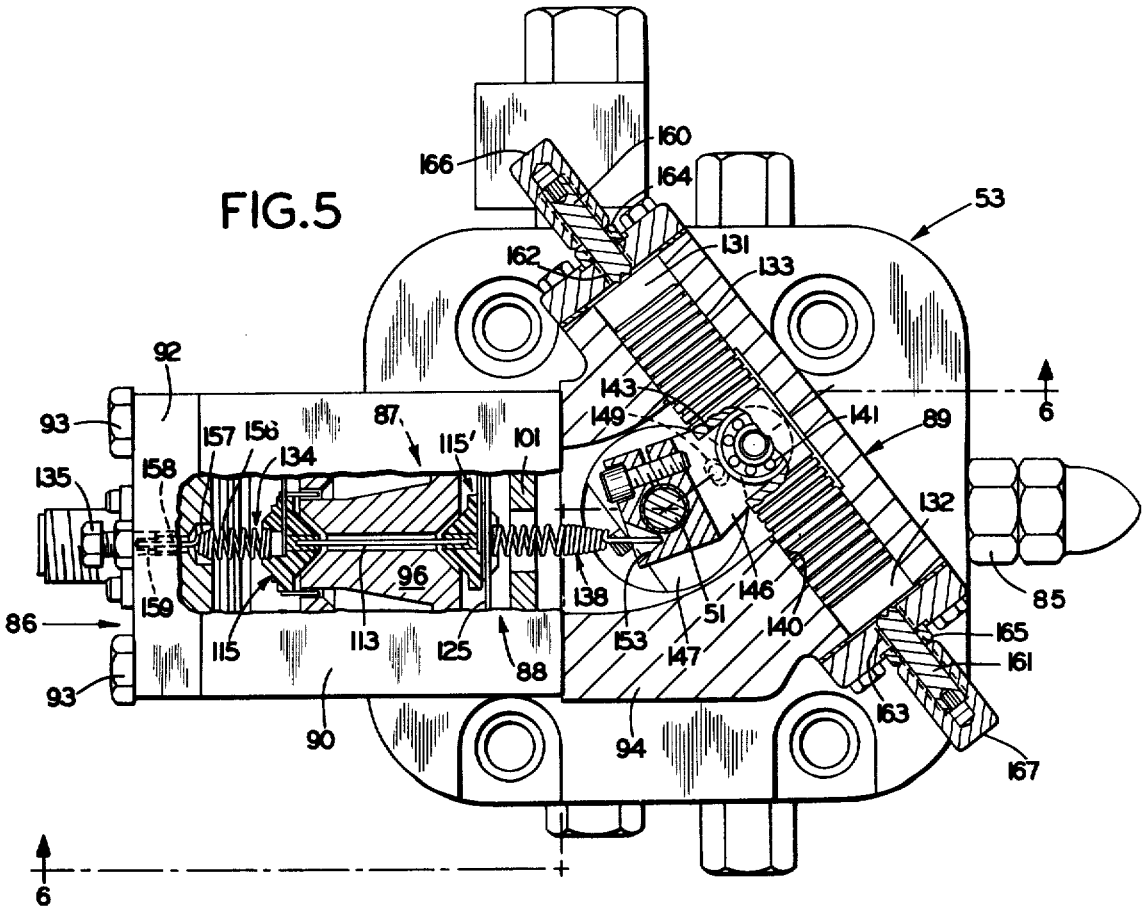

ELECTROHYDRAULIC CONTROL FOR AN AXIAL PISTON PUMP

BACKGROUND OF THE INVENTION

The instant invention relates generally to variable displacement axial piston pumps and, more specifically, to a device for changing pump displacement.

A common type of axial piston pump includes a housing having a rotatably mounted barrel with a plurality of circumferentially spaced cylinder bores. A port plate is interposed between the barrel and the inlet and working ports of the device so to alternately connect each cylinder bore with the inlet and working ports as the barrel is rotated. Within each bore is a piston which is connected by shoes to a thrust plate assembly mounted on a pivotal rocker cam assembly. When the barrel is rotated the shoes slide across the thrust plate, which causes the pistons to reciprocate and pump fluid.

In one form of variable displacement axial piston pump, the rocker cam assembly is pivoted about an axis perpendicular to the axis of rotation of the barrel to vary the inclination of the thrust plate assembly. This changes the stroke of the pistons and, consequently, changes the displacement of the pump. An example of such a pump is disclosed in U.S. Pat. No. 3,967,541. In thispatent, a manually operated valve on the pump regulates pressure fluid flow to a fluid motor which, when operated, changes the inclination of the rocker cam.

In some installations, it is not convenient to manually operate a pump mounted control device to set and change the displacement of a pump. For example, in some installations, a pump and its attendant control device are inaccessible to an operator and the control device cannot be operated manually.

It is desirable to provide a control device for a variable displacement pump which can be operated from a remote location. One type of control device which can be operated from a remote location, or which can operate another device located remotely therefrom, is an electrically controlled servo valve. U.S. Pat. No. 3,401,711 discloses a single receiver, electrically operated, jet-type servo valve. The servo valve has an electric force motor which operates a pilot stage and a main stage. The main stage includes a spool valve which controls the flow of fluid to a hydraulic motor or similar device which can be at a remote location. The operation of the spool valve is controlled by the pilot stage.

A problem with using a servo valve where the pilot stage operates a spool valve, which in turn controls fluid flow to a hydraulic device such as a fluid motor to set the displacement of a pump, is that the pump cannot be easily adapted to manual operation which is desirable in the event the control fails. Accordingly, it is desirable to provide an electrically operated control for a pump which also allows the pump to be manually operated.

SUMMARY OF THE INVENTION

The instant invention provides a control for a variable displacement pump which includes an electrically operated dual receiver port, jet-type servo actuator which sets the displacement of the pump. Pump displacement can also be set manually when fluid flow to the servo actuator is interrupted.

DESCRIPTION OF THE DRAWINGS

FIG. 5 is a plan view partially broken away showing the servo actuator of the instant invention attached to the cover plate;

FIG. 6 is a partial sectional view along line 6—6 of FIG. 5;

DESCRIPTION OF THE PREFERRED EMBODIMENT

Figure 1:
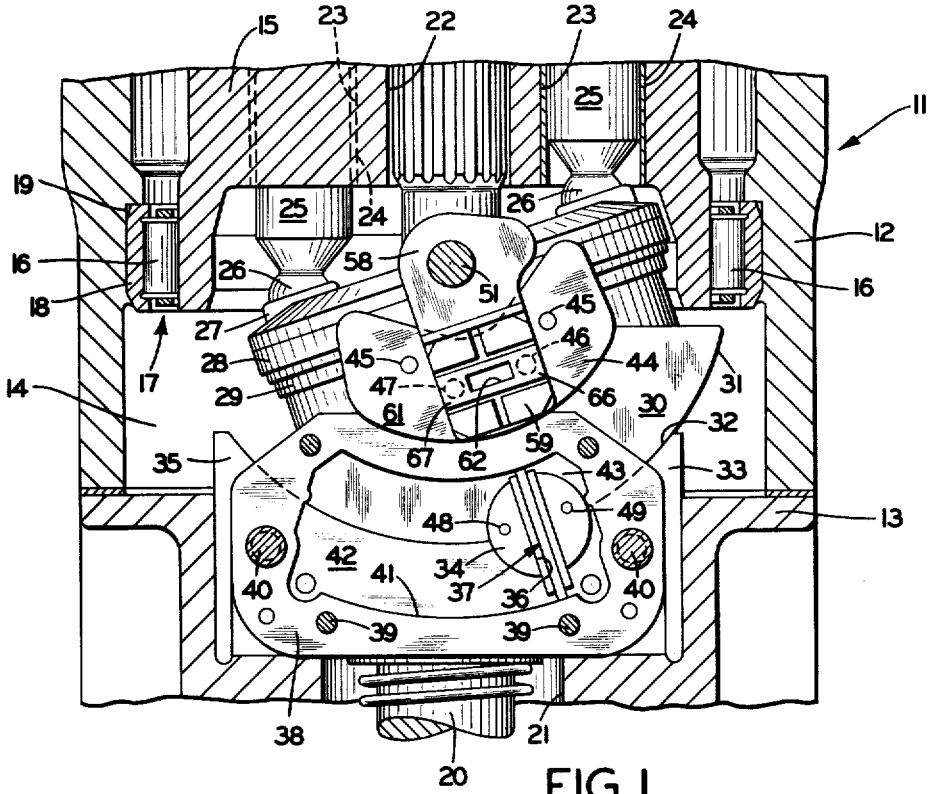
FIG. 1 is a part sectional view of an axial piston pump and a portion of the manual displacement control device therefor.

Referring to FIG. 1, an axial piston pump has a case 11 which includes a central housing 12, an end cap 13 at one end and a port cap, not shown, at the other end. Case 11 may be fastened together by bolts or other known means.

Case 11 has a cavity 14 in which a rotatable cylinder barrel 15 is mounted on rollers 16 of a bearing 17 which has its outer race 18 pressed against a housing shoulder 19. A splined drive shaft 20 passes through a bore 21 in end cap 13 and engages a splined central bore 22 in barrel 15 to thereby drive the pump.

Barrel 15 has a plurality of bores 23 equally spaced circumferentially about its rotational axis. A sleeve 24 in each bore 23 receives a piston 25. Each piston 25 has a spherical head 26 which is received in a socket 27 of a shoe 28. Each shoe 28 is retained against a flat creep or thrust plate 29 mounted on a movable rocker cam 30 by a shoe retainer assembly described in U.S. Pat. No. 3,967,541, which also describes in greater detail the pump and manual displacement control described herein and which is assigned to the assignee of the instant invention.

Rotation of drive shaft 20 by a prime mover, such as an electric motor, not shown, will rotate barrel 15. If rocker cam 30 and thrust plate 29 are inclined from a neutral or centered (minimum fluid displacement) position, normal to the axis of shaft 20, the pistons will reciprocate as the shoes 28 slide over thrust plate 29. As pistons 25 move outward of barrel 15 toward rocker cam 30, as viewed in FIG. 1, low pressure fluid is received in the sleeves 24. As the pistons move inward in barrel 15 toward the port plate, not shown, they expel high pressure fluid into an exhaust port. Pump displacement increases as the inclination of thrust plate 29 increases.

The pump displacement changing mechanism will next be described. Rocker cam 30 has an arcuate bearing surface 31 which is received in a complementary surface 32 formed on a rocker cam support 33 mounted in end cap 13. Rocker cam 30 is pivoted in rocker cam support 33 by a fluid motor.

A vane or motor member 34 is formed integrally with the side of rocker cam 30 so as to be rigidly secured thereto and movable therewith. The vane 34 extends beyond bearing surface 32 to overlie the side 35 of rocker cam support 33 so that the center of vane 34 is at surface 32. The vane 34 has a central slot 36 which receives a seal assembly 37.

A vane housing 38 is located on support 33 by pins 39 and is attached to support 33 by bolts 40. One half of vane housing 38 overlies rocker cam 30 so that vane 34 is received in an arcuate chamber 41 in the housing 38. A cover, not shown, closes the end of vane housing 38 and is secured by bolts 40. As thus assembled, vane 34 and its seal assembly 37 divide chamber 41 into a pair of expansible fluid chambers 42, 43 to form a fluid motor.

The fluid motor is operated by supplying pressurized fluid to one of the chambers 42, 43 and simultaneously exhausting fluid from the other chamber 42, 43 to move vane 34 within chamber 41. The operation of the fluid motor is controlled by a servo or follow-up control valve mechanism which regulates the supply of pressurized fluid to chambers 42, 43. The mechanism includes a fluid receiving valve plate 44 mounted on rocker cam 30 by bolts 45. The fluid receiving valve plate 44 and vane 34 move along concentric arcuate paths when rocker cam 30 is moved. Valve plate 44 has a pair of ports 46, 47 which are connected to respective chambers 42, 43 through a pair of drilled passageways 48, 49 which terminate in vane 34 on either side of seal assembly 37.

For counterclockwise operation of the fluid motor, as viewed in FIG. 1, pressure fluid is supplied to port 46 and flows through passageway 48 into chamber 42 to move vane 34 and rocker cam 30 counterclockwise. Expansion of chamber 42 causes chamber 43 to contract and exhaust fluid through passageway 49 out of port 47 and into the pump casing. For clockwise operation of the fluid motor, the fluid flow is reversed. Pressure fluid is supplied to port 47, flows through passageway 49 and expands chamber 43 to move vane 34 and rocker cam 30 clockwise. Chamber 42 contracts and exhausts fluid through passageway 48 out of port 46 and into the pump casing.

Figure 2:
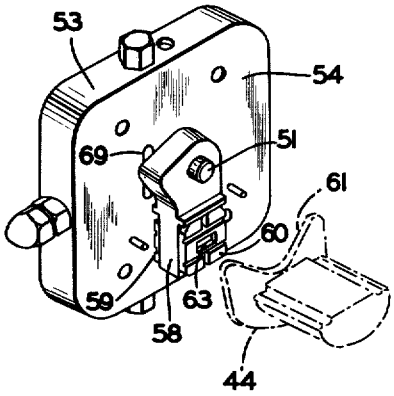
FIG. 2 is a perspective view showing the inner side of a cover plate which forms part of the housing for the displacement control device for the axial piston pump of FIG. 1.
Figure 3:
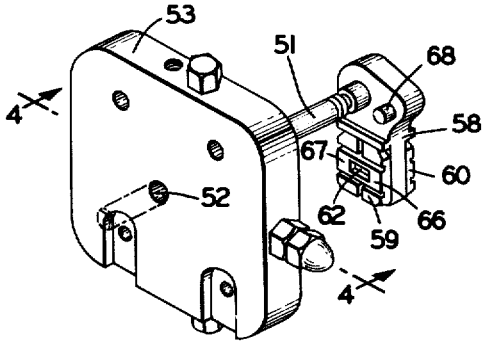
FIG. 3 is a perspective view showing the outside of the cover plate of FIG. 2 without the servo actuator of the instant invention fastened thereon.

Referring to FIGS. 1-3, that portion of the follow-up control valve mechanism which selectively supplies fluid to ports 46, 47 in valve plate 44 will now be described. An input shaft 51 is mounted in a bore 52 in a cover plate 53 and projects outwardly from cover plate 53 for attachment to the electrically operated servo actuator of the instant invention, as described herein below. An arm 58 positioned on the inside of cover plate 53 is fastened to the portion of input shaft 51 which projects inwardly from cover plate 53. Cover plate 53 is attached to housing 12 by conventional fastening means, such as bolts, not shown.

An input valve member includes a pair of identical valve shoes 59, 60 which are received in a bore, not shown, in arm 58. Shoe 59 rides on flat inner surface 54 of cover plate 53 and shoe 60 rides on flat surface 61 of valve plate 44. Each shoe 59, 60 has a central bore, not shown, which opens into fluid ports 62, 63, respectively. Ports 62, 63 are aligned with and in fluid communication with each other and are continuously fed fluid from a port, not shown, in cover plate 53.

Operation of the fluid motor by the servo control valve mechanism to change the displacement of the pump will now be described. When the fluid motor is at rest, fluid port 63 in shoe 60 lies between valve ports 46, 47 and the ports are covered by flats 66, 67 on the shoe. To change the displacement of the pump, input shaft 51 is rotated in the direction rocker cam 30 is to pivot. Thus, if input shaft 51 is moved clockwise, as viewed in FIG. 3, this moves shoe 60 clockwise and aligns fluid port 63 with port 47 while port 46 is uncovered. Pressure fluid flows from port 63 into port 47 through passageway 49 and into chamber 43. Simultaneously, fluid exhausts from chamber 42 through passageway 48 and out uncovered port 46. This pivots rocker cam 30 clockwise as described above. Rocker cam 30 is pivoted counterclockwise in a similar manner when input shaft 51 is moved counterclockwise to align port 63 with valve plate port 46.

Accurate follow-up is provided since angular movement of rocker cam 30 and valve plate 44 is equal to that of input shaft 51. When rocker cam 30 and valve plate 44 have moved through the same angle as input shaft 51, port 63 is centered between ports 46, 47 while flats 66, 67 cover ports 46, 47 and the fluid motor stops.

Figure 4:
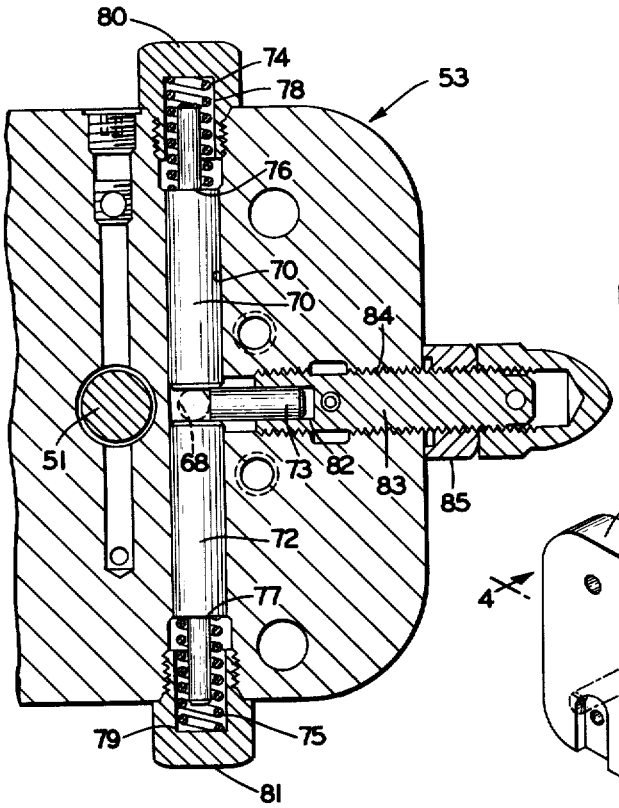
FIG. 4 is a part sectional view taken along line 4—4 of FIG. 3 showing a device in the cover plate for biasing the pump displacement control to the central position.

FIG. 4 discloses a mechanism for automatically centering or destroking the pump by moving input shaft 51 to the minimum displacement position when there is no force tending to rotate the input shaft 51. This mechanism is described in detail in U.S. Pat. No. 3,982,470, which is assigned to the assignee of the subject invention. An operating member in the form of a pin 68 projects from arm 58 (see FIG. 3) upwardly through an elongated slot 69 in cover plate 53 (see FIG. 2) and into a bore 70. A pair of opposed spools 71, 72 in bore 70 engage pin 68 and are biased by springs 74, 75 to a centered position, where they engage stop means or pin 73. Springs 74, 75 seat on spool shoulders 76, 77 and engage the bottom of bores 78, 79 in end caps 80, 81, respectively.

Pin 68 is the same diameter as stop pin 73 so that the position of pin 68 and arm 58 is accurately determined by the position of pin 73. Stop pin 73 is mounted in an eccentric bore 82 of a member 83 threaded into a bore 84. To adjust the minimum displacement or neutral position of rocker cam 30, member 83 is rotated and stop pin 73 moves axially in bore 70. This moves the stop position of the spools 71, 72 and pin 68 which pivots arm 58. When the fluid motor positions rocker cam 30 in the neutral position, member 83 is secured by a lock nut 85.

Referring to FIGS. 5 and 6, the electrically operated servo actuator 86 of the instant invention is shown mounted on the outside of cover plate 53. It is attached to cover plate 53 by bolts, not shown. Actuator 86 includes an electric force motor 87, a pilot stage 88 and an output or main stage 89. The pilot stage 88 is an amplifier which receives a force from motor 87 and produces an output having a magnitude and direction proportional to the force. This output operates a movable member in the main stage 89 which rotates input shaft 51. The construction and operation of servo actuator 86 and the connection of main stage 89 to the input shaft 51 will next be described.

Figure 7:
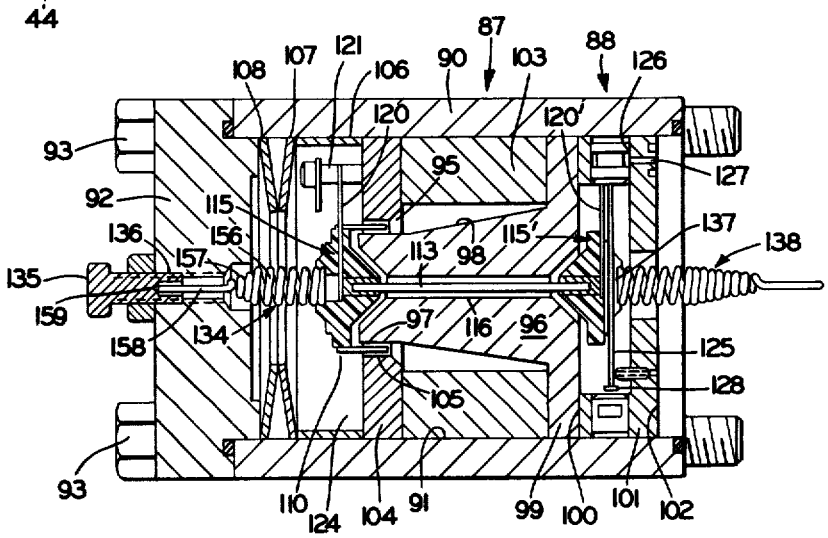
FIG. 7 is a sectional view along line 7—7 of FIG. 6 of the force motor and pilot stage of the servo actuator.

Referring to FIGS. 5–7, the force motor 87 and pilot stage 88 are enclosed in a cylindrical chamber 91 formed in a housing 90. Housing 90 is closed at one end by a cap 92. The other end of housing 90 abuts a main stage housing 94. Bolts 93 pass through cap 92 and housing 90 and enter main stage housing 94 to attach the two housings.

The force motor 87 includes an inner pole piece 96 which has a cylindrical portion 97 at one end and a tapered body 98 which connects cylindrical portion 97 with a flange 99 at the opposite end. Flange 99 is seated on the top surface 100 of a pilot stage mounting plate 101 which rests against the bottom 102 of chamber 91. One end of a cylindrical permanent magnet 103 is mounted on the top surface of flange 99. A cylindrical outer pole piece 104 is seated on the other end of permanent magnet 103 and has an inner surface 95 which cooperates with inner pole piece cylindrical portion 97 to define an annular gap 105. Magnetic flux is directed radially across the gap 105.

A spacer 106 and a pair of Belleville spring washers 107, 108 between outer pole piece 104 and end cap 92 locate the force motor and the pilot stage mounting plate 101 in chamber 91.

In the instant invention, the pole pieces 96, 104 are arranged so that gap 105 is in a cavity 124 remote from pilot stage 88. Consequently, a relatively small amount of oil flows into cavity 124 and a reduced number of iron particles in the oil are attracted to the pole pieces 96, 104 in the area of the gap 105. This prevents the movable coil 110 from getting stuck due to a build-up of particles.

Figure 9:
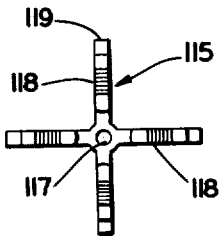
FIGS. 9 and 10 are enlarged views of opposite sides of the spiders shown in FIG. 8.
Figure 8:
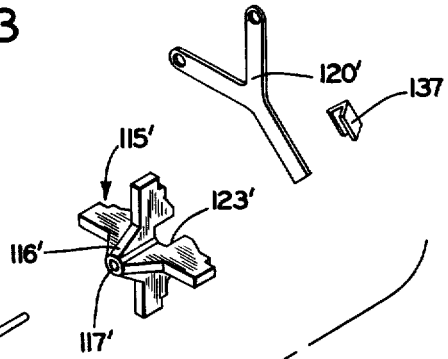
FIG. 8 is an exploded view of the movable elements in the electric force motor.
Figure 10:
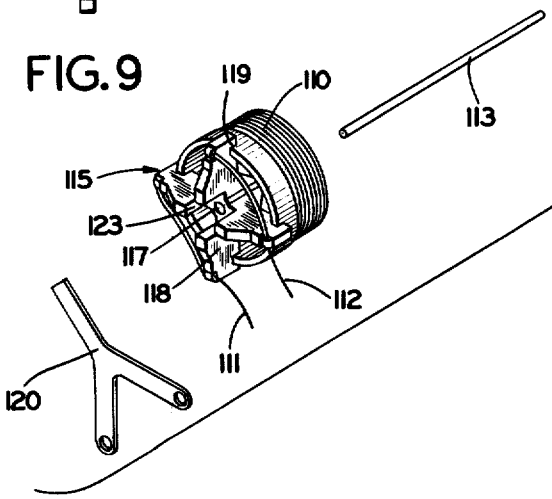
Figure 10:
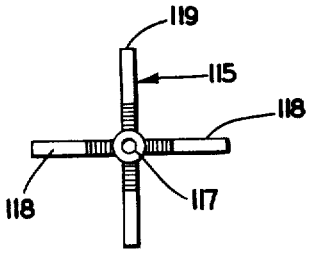

Referring to FIGS. 8–10, the movable parts of force motor 87 include a coil 110 which is axially movable in the annular gap between the inner and outer pole pieces 96, 104, and is mounted on a spider 115 which is made from a non-magnetic material, such as plastic. Electric current is supplied to coil 110 through wires 111, 112. The spider 115 is connected to an identical second spider 115' by an actuator shaft 113. The spiders 115, 115' are resiliently mounted at opposite ends of force motor 87 as described below.

Each spider 115, 115' has a nose 116, a central hole 117 and four radially projecting legs 118 with slots 119 near the end. Coil 110 is received in slots 119 in spider 115. Each spider 115, 115' also has a central slot 123 opposite nose 116 which receives one arm of a three-armed spring 120, 120' which resiliently mounts the spider 115, 115'. Two arms of mounting spring 120 are attached to posts 121, on outer pole piece 104, by screws, not shown, to thereby mount spider 115 adjacent pole piece 104. The two arms of mounting spring 120' are attached to posts on mounting plate 101 by srews, not shown, to thereby mount spider 115' adjacent pilot stage 88. The two spiders 115, 115' are connected by an actuator shaft 113 which projects from hole 117 in spider 115, passes through a bore 114 in pole piece 96 and is secured in hole 117' in spider 115'. A V-shaped anvil 137 is located in slot 123' in spider 115' and engages a movable member in the pilot stage 88. Thus, springs 120, 120' provide a resilient, low friction mounting for coil 110, actuator shaft 113 and spiders 115, 115'.

When current is supplied to coil 110, the coil 110 moves axially in gap 105. The magnitude and direction of the axial movement is determined by the input current. Movement of coil 110 and spider 115 is transmitted to spider 115' through actuator shaft 113. Movement of spider 115' operates pilot stage 88, as described below.

The pilot stage 88 includes a thin, hollow jet tube or pipe 125 which has one end mounted in a hole 126 in the pilot stage mounting plate 101, as best shown in FIG. 7. Since jet tube 125 is long relative to its diameter, a lateral force directed against the side of the tube 125 will cause the free or discharge end 128 of the tube to deflect an amount proportional to the force. The V-shaped anvil 137 on spider 115' engages one side of tube 125. In this way, axial movement of coil 110 is transmitted to the jet tube 125. The magnitude of the force exerted on the tube 125 by anvil 137 is directly proportional to the magnitude and direction of the current input to coil 110.

Figure 12:
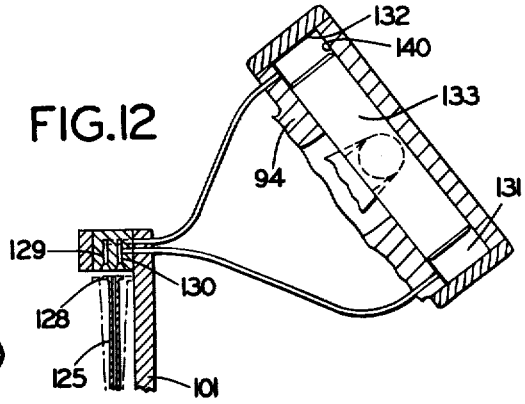
FIG. 12 is a schematic view showing the connection between the receptor ports in the pilot stage and the piston in the main stage of the subject servo actuator.

A source of servo pressure fluid, not shown, is connected to a hole 127 in mounting plate 101. Hole 127 opens into a hole 126 which is connected to the inlet end of jet tube 125. The servo pressure fluid flows through tube 125 and exhausts from the discharge end 128 of the tube 125, which is positioned immediately above a pair of receptor ports 129, 130 in mounting plate 101 which receive the pressure fluid as shown in FIG. 12. When jet tube 125 is moved by coil 110 in the force motor, the tube 125 supplies an increased amount of fluid at a higher pressure to one receptor port 129, 130 and a reduced amount of fluid at a lower pressure to the other port.

Referring to FIGS. 5 and 12, main stage 89 includes a piston 133 which is movable in a bore 140 in main stage housing 94. The receptor ports 129, 130 in pilot stage 88 are connected through fluid passages 154, 155 to chambers 132, 131 formed at the ends of piston 133 in bore 140. The position of discharge end 128 with respect to ports 129, 130 determines whether piston 133 is stationary or moving. If end 128 is centered between ports 129, 130, each port receives equal amounts of servo fluid at the same pressure, each chamber 131, 132 is at the same pressure and piston 133 is stationary. If end 128 is nearer one port 129, 130 than the other port 129, 130, the one port receives an increased amount of servo fluid at a greater pressure than the other port, one chamber 131, 132 receives fluid at a greater pressure than the other chamber 131, 132 and the pressure differential across piston 133 causes it to move.

Main stage 89 includes a device to limit the maximum displacement of the pump. Screws 160, 161 are threaded into bores 162, 163, respectively, in housing 94 at opposite ends of bore 140. The screws 160, 161 limit the outward movement of piston 133 and thereby limit the maximum displacement setting of the pump by servo actuator 87. Lock nuts 164, 165 prevent the screws 160, 161 from moving and protective caps 166, 167 cover the screws.

The attachment of main stage piston 133 to input shaft 51 can best be seen by reference to FIGS. 5 and 6. A drive arm 147 is rigidly affixed to input shaft 51 adjacent an idler arm 146 which is mounted on bearings on shaft 51. Idler arm 146 is connected to main stage piston 133 by a stub shaft 144 which has one end pressed into a bore 145 in arm 146. A bearing 141, which has a part-spherical shaped outer surface 142, is pivoted on the other end of shaft 144 and has outer surface 142 mounted in a slot 143 in the center of piston 133.

A lost motion mechanism connects the two arms 146, 147. A pin 148, which has one end pressed into drive arm 147, projects into an arcuate groove 149 formed in idler arm 146. The groove 149 is of sufficient length to permit a small amount of relative movement between idler arm 146 and drive arm 147. This lost motion mechanism permits a small amount of movement of main stage piston 133 without a corresponding movement of input shaft 51 at the zero displacement position. This prevents movement of piston 133 due to temperature changes within servo actuator 86 from affecting the displacement of the pump at the zero flow position. When input shaft 51 is not at the zero displacement position, centering springs 74, 75 eliminate any lost motion.

Figure 11:
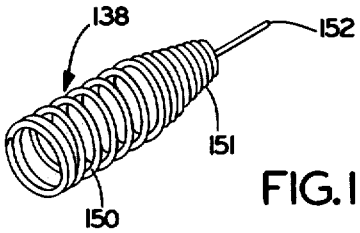
FIG. 11 is an enlarged perspective view of the feedback spring used in the servo actuator of the instant invention.

The jet tube 125 in pilot stage 88, in addition to receiving a force command from the force motor 87, receives a feedback force from input shaft 51. Referring to FIGS. 5 and 11, a feedback spring 138, which includes a coiled bottom portion 150, a tightly wound conical portion 151 and a tip 152 projecting axially from portion 151, has the tip 152 mounted in a feedback socket 153 in drive arm 147 and the coiled portion 150 mounted in the center of spider 115' adjacent jet tube 125. The feedback spring 138 counterbalances the force exerted on jet tube 125 by coil 110 and centers the tube 125 between the receptor ports 129, 130 when input shaft 51 reaches the set position.

Due to tolerances in the parts and the mechanical connections, it is necessary to have a null adjustment. A compression null spring 134, which includes a coiled bottom portion 156, a tightly wound conical portion 157 and a tip 158, has the coiled portion 156 mounted in the center of spider 115 adjacent mounting spring 120 and the tip 158 mounted in the bore 159 of an adjustment screw 135. Adjustment screw 135 is mounted in a threaded bore 136 in end cap 92 and is adjusted to force null spring 134 to apply an axial force on spiders 115, 115' and actuator shaft 113 to center jet tube 125 between receptor ports 129, 130 when coil 110 is de-energized and the pump is in the neutral or centered position.

The operation of the hydraulic actuator 86 of the instant invention is as follows. An electrical input in the form of a low voltage, direct current is supplied to coil 110 in force motor 87. This causes coil 110, spiders 115, 115' and actuator shaft 113 to move axially. Axial movement of spider 115' causes jet tube 125 in pilot stage 88 to be displaced relative to receptor ports 129, 130. In the displaced position, jet tube 125 supplies fluid at increased pressure to one of the chambers 131, 132 adjacent the ends of piston 133 in the main stage 89 and fluid at reduced pressure to the other chamber 131, 132. The pressure differential causes main stage piston 133 to move in axial bore 140 and pivot idler arm 146 on input shaft 51. Movement of idler arm 146 causes corresponding movement of drive arm 147 through the lost motion mechanism and corresponding rotation of input shaft 51. Rotation of input shaft 51 operates the displacement changing mechanism of the pump as described above.

Feedback from input shaft 51 to jet tube 125 is as follows. As drive arm 147 is rotated, feedback socket 153 pivots and the force exerted on feedback spring 138 increases. Feedback spring 138 applies a force to the side of jet tube 125 which tends to center the tube 125 between receptor ports 129, 130. Axial movement of piston 133 and corresponding movement of drive arm 147 continue until an equilibrium is established between the forces acting on each side of jet tube 125 and the jet tube is centered between receptor ports 129, 130.

The actuator 86 of the instant invention is a fail-safe device. If the supply of servo pressure fluid to jet tube 125 is interrupted, the fluid pressure at receptor ports 129, 130 and at each end of piston 133 is equal and the centering springs 74, 75 automatically move the input arm to the minimum pump displacement position. The fail-safe feature of the hydraulic actuator 86 also allows the pump input shaft 51 to be manually operated. A manual operating arm 170 is rigidly attached to input shaft 51. When the actuator 86 of the instant invention is rendered inoperative by the interruption of servo pressure fluid thereto, displacement of the pump can be set manually by movement of the handle 170. In this instance, the handle 170 must be held in the desired position, since the centering springs 74, 75 will automatically set the displacement of the pump at the minimum displacement position if input shaft 51 is not acted upon by actuator 86 or a force on manual input handle 170.

From the above, it is apparent that the instant invention provides a control for setting the displacement of a variable displacement, axial piston pump which can be operated electrically and which, when disabled, permits manual operation of the pump displacement setting device.

Obviously, those skilled in the art may make various changes in the detailed arrangements of parts without departing from the spirit and scope of the invention as it is defined by the claims hereto appended.

We claim:

1. A control for an axial piston pump having a housing, a cover plate closing an opening in the housing, a pair of fluid ports, a pivotably mounted thrust plate for changing the displacement of the device, a fluid motor for pivoting the thrust plate between a position of maximum fluid displacement in one direction and a position of maximum fluid displacement in the other direction with a centered position of minimum fluid displacement therebetween, means for supplying servo pressure fluid to operate said fluid motor including an input device for selectively operating the fluid motor to move the thrust plate to the position set by the input device, and the improvement comprising: a servo actuator including an electric force motor, a pilot stage and a main stage, wherein the force motor provides a signal to the pilot stage proportional to the magnitude of the electrical input to the motor, the pilot stage provides a fluid input to the main stage proportional to the signal it receives from the force motor; means for supplying servo pressure fluid to said pilot stage; means for connecting the main stage of the servo actuator with the input device so that said input device moves in response to movement of the main stage; a feedback mechanism connected between the input device and the pilot stage; means for manually operating said input device; and said manual operating means being able to operate said input device when the supply of servo pressure fluid to the pilot stage is interrupted.

2. The control recited in claim 1, including spring meand for moving the input device to a centered position which sets the inputs device to the minimum fluid displacement position when the supply of servo pressure fluid to the pilot stage is interrupted.

3. The control recited in claim 1, wherein said connecting means includes a lost motion device which permits limited movement of the servo actuator main stage due to temperature changes in the servo actuator without disturbing the input device at the minimum displacement setting so that temperature changes in the servo actuator will not change the minimum displacement setting of the pump.

4. The control recited in claim 1, wherein the feedback mechanism includes a feedback socket mounted on the input device and a spring which at one end is tightly wound into a cone shape to increase the stiffness of the spring, a tip projects from the end of the cone, and the spring tip engages the feedback socket.

5. The control recited in claim 1, wherein the pilot stage of the servo actuator includes a jet tube which is positioned between a pair of receptor ports, servo pressure fluid flows through the jet tube, movement of the jet tube causes it to supply servo pressure fluid at increased pressure and volume to one of the receptor ports to operate the main stage in one direction to thereby move the input device in one direction to operate the fluid motor in one direction, the force motor includes an electrical coil, a link connected to the coil, said link engaging the jet tube and applying a force to the jet tube proportional to the electrical input to the coil, means for resiliently mounting the link, and a null adjustment means attached to the link for centering the jet tube between the receptor ports when no current is supplied to the coil.

6. The control recited in claim 5, wherein the null adjustment means includes a null spring which has one end tightly wound into a cone shape to increase the stiffness of the spring and a tip projects from the end of the cone, the null spring has one end seated against the link and means for adjusting the force of the spring on the link.

7. The control recited in claim 5, wherein the force motor includes a pair of spiders, one spider is attached to each end of the link, the coil is attached to one of the spiders, the other spider engages the jet tube and means for resiliently mounting each spider to provide a low friction mounting for the spiders, the coil and the link.

8. The control recited in claim 7, wherein the coil is mounted on the spider located at the end of the force motor remote from the pilot stage to isolate the coil from the servo fluid in the pilot stage.

9. The control recited in claim 1, wherein the main stage includes a piston axially movable in a bore and stop means connected to the main stage for limiting movement of the piston to thereby limit movement of the input device.

10. The control recited in claim 9, wherein the connecting means includes a slot in the piston, and a pin having a spherical bearing is received in the slot and the bearing accommodates misalignment between the pin and slot.

* * * * *